United States Patent [19]

Fujimura et al.

[11] 3,977,917

[45] Aug. 31, 1976

[54] PERMANENT MAGNET MATERIALS

[75] Inventors: Yasuo Fujimura; Masayuki Tada, both of Yokohama, Japan

[73] Assignee: Tohoku Metal Industries Limited, Japan

[22] Filed: July 31, 1974

[21] Appl. No.: 493,396

[30] Foreign Application Priority Data

June 17, 1974 Japan ..... 49-69387

[52] U.S. Cl. ..... 148/31.57; 75/152; 148/101; 148/103

[51] Int. Cl.$^2$ ..... H01F 1/04

[58] Field of Search ..... 148/31.57, 100, 101, 148/103; 75/152, 123, 170, 84

[56] References Cited

UNITED STATES PATENTS

| | | | |
|---|---|---|---|
| 2,813,789 | 11/1957 | Glaser | 75/123 |
| 2,829,048 | 4/1958 | Cochardt et al. | 75/170 |
| 3,295,963 | 1/1967 | Galvin | 75/152 |
| 3,424,578 | 1/1969 | Strnat et al. | 148/31.57 |
| 3,821,034 | 6/1974 | Wessendorp et al. | 148/31.57 |

OTHER PUBLICATIONS

Barbara, B. et al.; *Properties of Compounds $Tb_3Al_2$ and $D_{43}Al_2$*, in *Gr. Acad. Sc. Paris*, 267, pp. 244–247 (July, 1968).

Wernick, J. et al.; *Rare Earth Compounds with $MgCu_2$ Structure*, in *Trans. Aime*, Oct. 1968, pp. 866–868.

*Primary Examiner*—Walter R. Satterfield

*Attorney, Agent, or Firm*—Carothers and Carothers

[57] ABSTRACT

Samarium cobalt magnetic materials for permanent magnets comprising, by atomic ratio relative to the samarium content, samarium of 1, cobalt of 4.0–5.2 and at least one addition selected from silicon up to 5.8 wt.% or 0.82 by atomic ratio to the samarium, germanium up to 8.5 wt.% or 0.57 by atomic ratio to the samarium and aluminum up to 4.75 wt.% or 0.82 by atomic ratio to the samarium, and having increased intrinsic coercive force and decreased irreversible magnetic induction loss with temperature. In the case wherein the total amount of the aforesaid addition or additions is limited, by atomic ratio to the samarium, to up to 0.25, the samarium cobalt magnetic materials may provide sintered permanent magnets having a reduced irreversible magnetic induction loss with temperature, without decreased residual magnetic flux density. When the total amount of the aforesaid addition is restricted, by atomic ratio to samarium, to up to 0.21, the resulting material may provide compacted permanent magnets having reduced irreversible magnetic induction loss with temperature, without any reduction of residual magnetic flux density.

7 Claims, 6 Drawing Figures

PERMANENT MAGNET MATERIALS

BACKGROUND OF THE INVENTION

This invention relates to Sm-Co permanent magnet materials and, more particularly, to the improvement of such magnetic materials for permanent magnets wherein the magnetic induction after baking may be maintained greater in comparison with known Sm-Co materials in the prior art.

Sm-Co alloys, in particular such alloys consisting of, by atomic ratio, Sm of 1 and Co of 4.0–5.2, have been used in the prior art for permanent magnet materials.

Sm-Co permanent magnets are classified into two classes, one being a compacted type and the other being a sintered type. In making a permanent magnet of a compacted type, Sm-Co alloy powder is put in an aligning magnetic field and is pressed into a compacted solid body. It is known that a binder is mixed with the powder.

In making a permanent magnet of a sintered type, a compact obtained by pressing the powder under the aligning magnetic field is subjected to a heat-treatment for sintering.

Sm-Co permanent magnets have been obtained which have a maximum energy product $(BH)_{max}$ close to the theoretical upper limit for the Sm-Co alloy.

But such permanent magnets have a disadvantage in that the magnetic properties vary in response to the variation of the temperature.

Variations of the magnetic properties in response to the temperature variation are classified into two types, one of which is called an irreversible temperature loss or an irreversible magnetic induction loss with temperature, and the other of which is called a reversible temperature loss.

The irreversible temperature loss is defined by following expression:

$$\frac{Bd_1 - Bd_0}{Bd_0} \times 100\ (\%)$$

where, $Bd_0$ is the value of the magnetic induction under the operating condition of a magnet magnetized at a room temperature and $Bd_1$ is the value of the magnetic induction of the magnet under the operating condition of room temperature after exposure of baking at an elevated temperature for a considerably long period.

The reversible temperature loss concerns the magnetic properties of the magnet after completion of the baking treatment and is the rate of the change of the value of the magnetic induction in response to a temperature variation of one degree within the temperature range below the baking temperature. Thus the reversible temperature loss is defined by following expression:

$$\frac{Bd\beta - Bd\alpha}{Bd\alpha} \cdot \frac{1}{T\beta - T\alpha} \times 100\ (\%)$$

where, $T_\alpha$ and $T_\beta$ ($T_\alpha < T_\beta$ are different temperatures below the baking temperature, $Bd_\alpha$ is a value of the magnetic induction at the temperature of $T_\alpha$ and $Bd_\beta$ is a value of the magnetic induction at the temperature of $T_\beta$.

Many reports have been provided relating to these irreversible and reversible temperature losses of the Sm-Co permanent magnet. Those reports teach us that the reversible temperature loss of the Sm-Co permanent magnet generally is within the range of −0.045 ± 0.005%/°C which is hardly changed by the variation of the operating point of the magnet. But the irreversible temperature loss considerably varies dependently on the change of the magnetic properties, the operating point and other factors of the magnet.

It is known that a permanent magnet having such a demagnetization characteristic wherein the shoulder portion of the curve within the second quadrant of the magnetic hysteresis curve (or 4 $\pi$I - H loop) exist on the greater demagnetizing field, has the lower irreversible temperature loss. And the greater the permeance factor is of the magnet at the operating point thereof, the lower is the irreversible temperature loss of the magnet. For example, after the Sm-Co permanent magnet of a rod shape having a dimensional ratio, or (the length in the direction of the easy magnetic axis of the magnet)/(the diameter of the magnet), of 0.4 and an intrinsic coercive force $_IH_C$ of 20 – 30 $KO_e$, has been heat-treated at a temperature of 300°C for 3 hours, the resulting irreversible temperature loss is about −10%. But some magnets having a similar dimensional ratio but an intrinsic coercive force less than 20 $KO_e$, exhibit irreversible temperature losses of values close to −90% after similar heat-treatment.

SUMMARY OF THE INVENTION

An object of this invention is to provide Sm-Co magnetic materials for permanent magnets having a reduced irreversible temperature loss.

Another object of this invention is to achieve the above object without any unfavorable effect on the other properties of the magnet.

The Sm-Co magnetic material according to this invention consists of, essentially, by atomic ratio (always with reference to the samarium or Sm content), Sm of 1, Co of 4.0–5.2 and at least one addition selected from the group of silicon up to 0.98 (5.8 wt.%), germanium up to 0.57 (8.5 wt.%) and aluminum up to 0.82 (4.75 wt.%).

The total amount of the addition may, preferably, be 0.25 or less by atomic ratio to the samarium. This material may provide Sm-Co permanent magnets having a reduced irreversible temperature loss without any unfavorable effect of the other properties. Moreover the sintering may be easily performed by the employment of this material.

Furthermore, the total amount of the addition may be 0.21 or less by atomic ratio to samarium. The Sm-Co magnetic materials including additions of 0.21 mols or less may provide improved Sm-Co permanent magnets of a compacted type.

The other objects and features of this invention will be understood from following descriptions relating to embodiments of this invention referring to the annexed drawings.

DETAILED DESCRIPTION OF PREFERRED EMBODIMENTS

This invention contemplates the addition of silicon, germanium and/or aluminum into the samarium cobalt alloy to provide Sm-Co permanent magnet materials having improved permanent magnet properties.

Figure 1A:
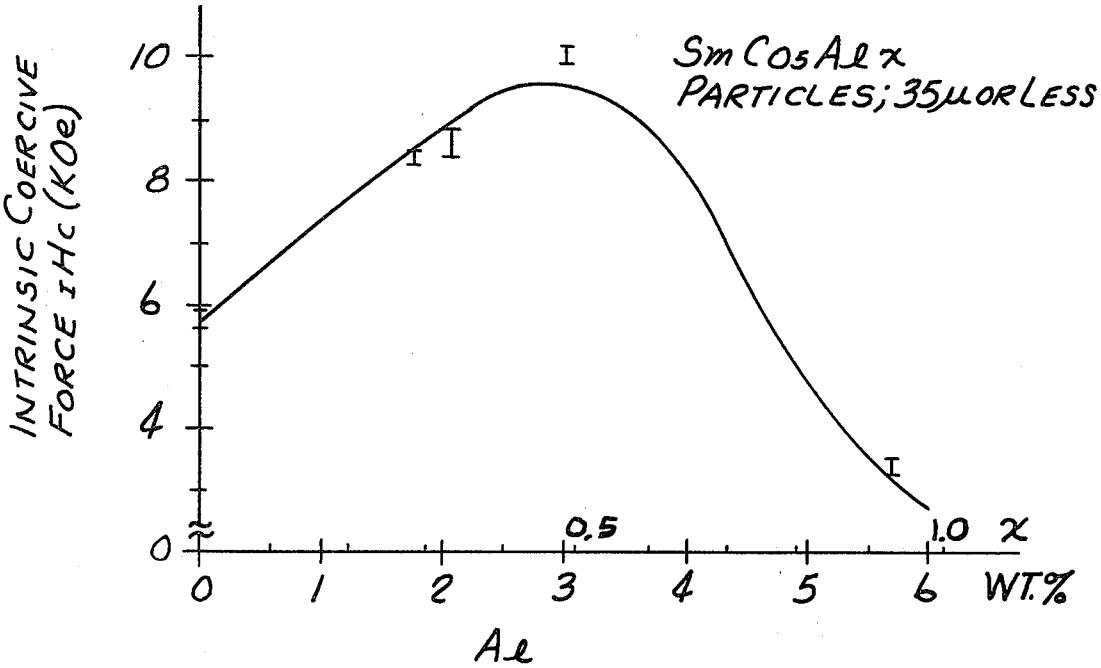
FIGS. 1*a* –1*c* graphically show the variations of the intrinsic coercive force $_IH_C$ of the respective Sm-Co alloy particles relative to the amount of the different additions included therein, FIG. 2 graphically shows the variation of the magnetic moment of a Sm-Co alloy particle to the amount of the addition included therein, FIG. 3 graphically shows the variations of the intrinsic coercive force $_iH_C$ of a $SmCo_5Si_{0.35}$ alloy particle and a $SmCo_5$ alloy particle relative to the particle size, and FIG. 4 graphically shows demagnetizing curves of three Sm-Co permanent magnets of a sintered type using a known Sm-Co alloy and alloys according to this invention.
Figure 1B:
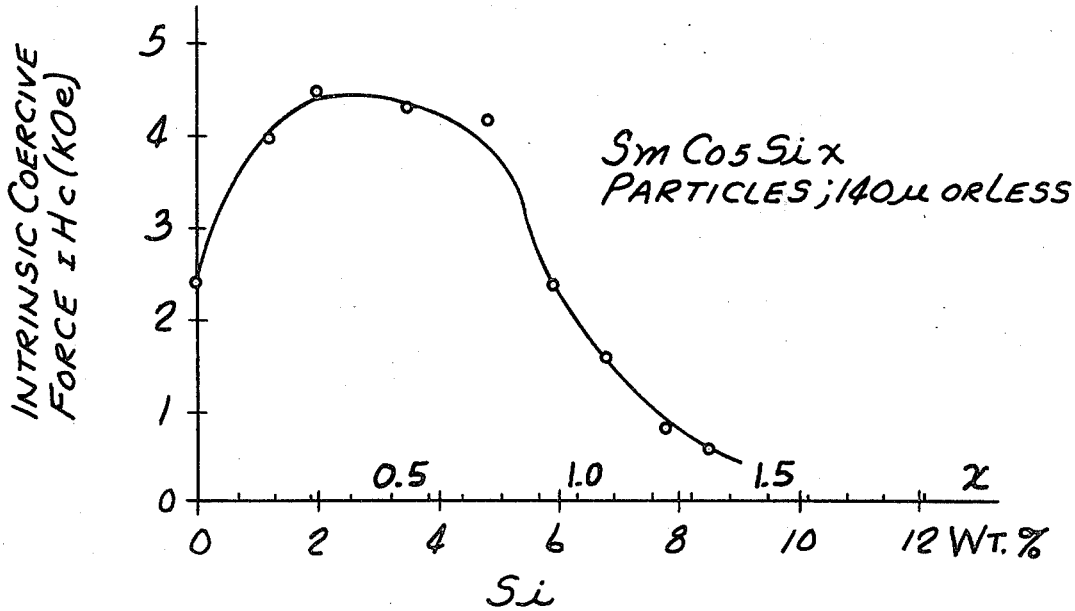
Figure 1C:
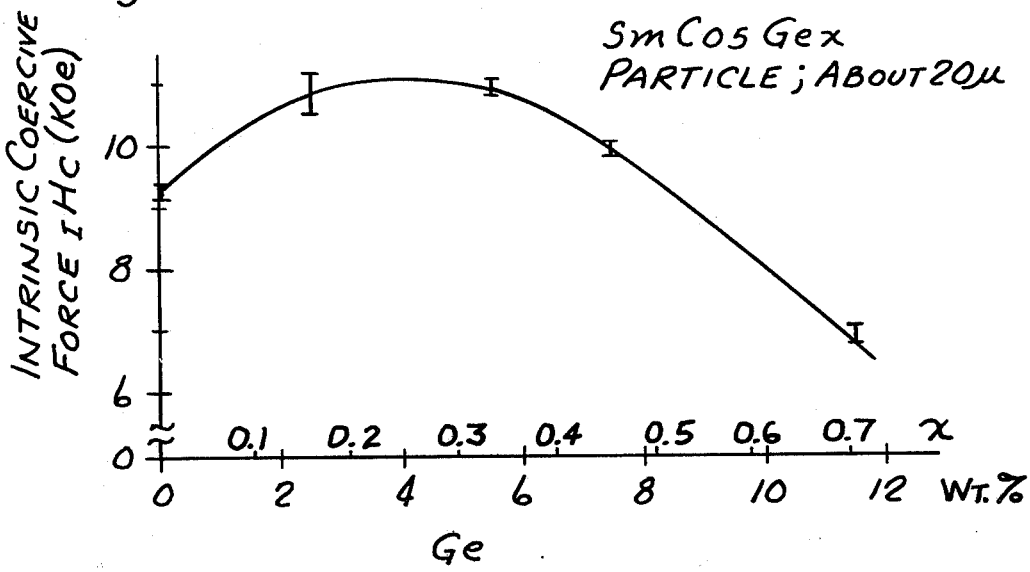

Referring to FIGS. 1*a* –1*c*, in which the variations of the intrinsic coercive force of the alloy particles represented by $SmCo_5M_x$ (M is addition and $x$ is amount of the addition M by molecular ratio to Sm) is shown relative to the amount of the different additions of Al, Si and Ge, it will be noted that the addition of Al of 4.75 wt.% (0.82 by atomic ratio to Sm) or less, Si of 5.8 wt.% (0.98 by atomic ratio to Sm) or less or Ge of 8.5 wt.% (0.57 by atomic ratio to Sm) or less, may remarkably increase the intrinsic coercive force of the Sm-Co alloy. This means that the shoulder portion within the second quadrant of the magnetic hysteresis curve is shifted onto the increased demagnetizing field. Accordingly, the irreversible temperature loss may be reduced by the addition in Al, Si or Ge of the amount as above described.

Figure 2:
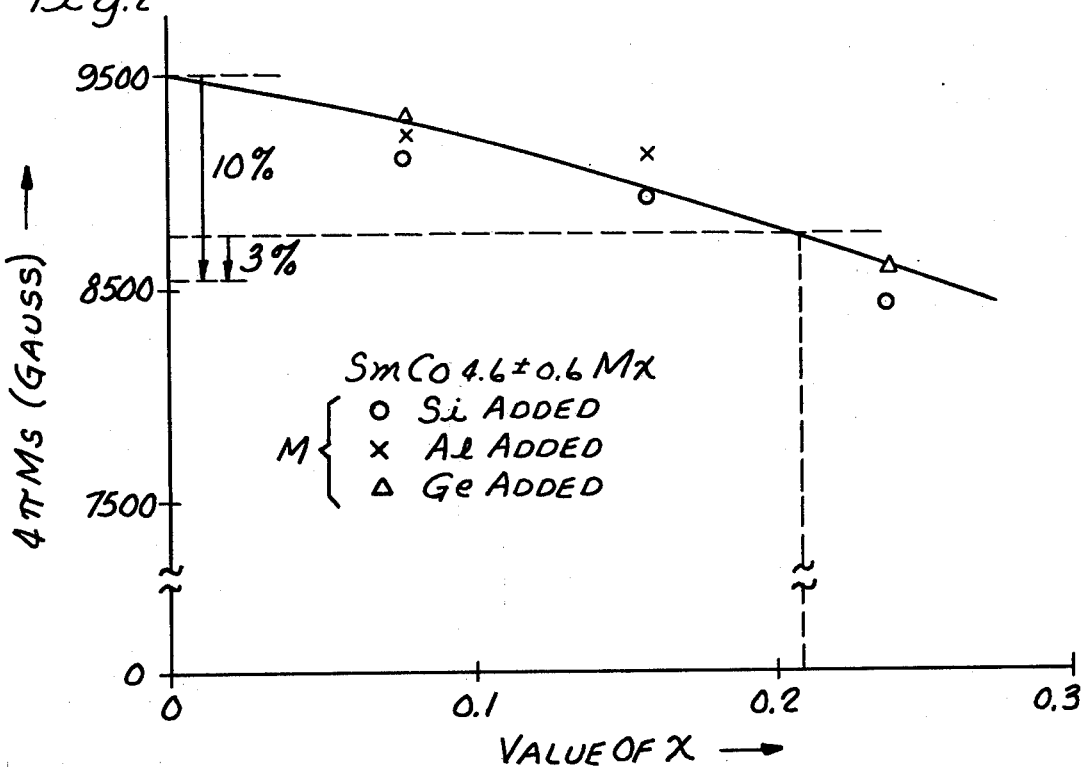

The magnetic moment 4 $\pi M_S$ of the samarium cobalt alloy represented by Sm $Co_5$ $M_x$ of a unit volume is obtained by the following method and is shown in FIG. 2.

The alloy powder of a mean particle size of 10 $\mu$m was mixed into melted paraffin wax at 100°C and, then, aligned by applying the orientating magnetic field. Thereafter the paraffin wax was cured by dropping the temperature to room temperature so that a solid body was obtained. Exposing the solid body in a magnetic field of 17.5 $KO_e$ at the room temperature, the magnetic moment of the solid body was measured. The measured value of the magnetic moment of the solid body was divided by the total weight of the powder mixed in the paraffin wax and the density of the alloy was multiplied to the resulting quotient, so that the magnetic moment 4 $\pi M_S$ of the alloy of a unit volume was calculated.

FIG. 2 teaches us that the magnetic moment of the alloy may reduce by the increase of the amount of additions.

Since the reduction of the magnetic moment effects the reduction of the magnetic induction B*d* and, therefore, the reduction of the residual magnetic flux density Br of the magnet, the amount of the addition should be limited so as to avoid unfavorable effects to the magnet properties.

It is an important feature of the Sm-Co permanent magnet that a maximum energy product $(BH)_{max}$ of 18 $MGO_e$ or more can be realized if the magnet is produced under best conditions. The amount of the addition should be limited within a range such that is important feature may not be badly affected.

In order that a permanent magnet of the compacted type, which is 100% in its packing fraction and is perfect in its field-orientation of particles, have the maximum energy product $(BH)_{max}$ of 18 $MGO_e$, the magnetic moment per unit volume of the alloy of the used particle is required to be 8500 G.

Referring to FIG. 2, when the amount of the addition $x$ is 0.26 or less by atomic ratio to Sm, the magnetic moment $4\pi M_S$ is maintained at 8500 $MGO_e$ or more. Accordingly the amount of the addition should be limited to less than 0.26 mol.

On the other hand, the permanent magnet made of the Sm-Co alloy including the addition, according to the teachings of this invention, also has an irreversible temperature loss of a certain degree. For example, magnets with the dimensional ratio of 0.4 made of Sm-Co alloy and including additions within a range less than 0.26 by atomic ratio to Sm exhibited an irreversible temperature loss of about −3% after a baking treatment of 300°C for 3 hours. A known Sm-Co permanent magnet with a similar dimensional ratio exhibits an irreversible temperature loss of about −10% after a similar baking treatment.

If the amount of the addition is so selected that the value is less than the magnetic moment $4\pi M_S$ of the Sm-Co alloy including additions therein by 3%, it may be equal to or greater than a corresponding value less than the magnetic moment $4\pi M_S$ of a known Sm-Co alloy by 10%. The magnet properties of the permanent magnet made of the alloy including the addition is superior to those of a known Sm-Co permanent magnet, after baking treatment.

It will be noted from FIG. 2 that the amount of the addition required to meet with the above condition is 0.21 or less by atomic ratio to Sm.

In the case of the magnet of the compacted type, the greater the packing fraction is, the more the magnet properties are improved. But, it is known in the prior art that in the case of a magnet of the sintered type, the intrinsic coercive force is reduced if the packing fraction is over a certain value. Therefore the packing fraction must be limited to less than the certain value. Accordingly, the magnetic induction of the sintered magnet is generally less than that of the alloy particle itself of the powder which is used to form the sintered magnet.

When the magnet is made by sintering the powder of $SmCo_5M_x$ (M: Si, Al or Ge) alloy, the powder can be pressed with greater packing fraction than the known sintered magnet without any reduction of the intrinsic coercive force of the magnet in comparison with that of the known sintered magnet, because the $SmCo_5M_x$ alloy according to this invention has an increased intrinsic coercive force in comparison with the known $SmCo_5$ alloy. Thus the sintered magnet made of the $SmCo_5M_x$ alloy powder according to this invention has a magnetic induction close to the magnetic induction of the particle itself of the $SmCo_5M_x$ alloy powder.

Accordingly, the $SmCo_5M_x$ alloy for making a permanent magnet of the sintered type may be permitted to include the addition M of more than 0.21 or up to 0.25 by atomic ratio to Sm.

Aluminum, silicon and germanium of 0.25 content by atomic ratio to Sm are calculated to be by weight as 1.5%, 1.6% and 3.9%, respectively.

The additions of Al, Si and Ge may be used in combination with each other.

Aluminum, silicon and germanium are included as impurities in the samarium and the cobalt, which both may be obtained commercially. In particular, the cobalt includes those impurities in considerable quantity, such as, by weight, up to 0.03% Si, up to 0.01% Ge and up to 0.08% Al.

On the other hand, when the starting mixture of Sm and Co is melted in a furnace, impurities including Al, Si and Ge are unfavorably mixed into the melt.

Accordingly known Sm-Co permanent magnets may include Al, Si and Ge as impurities. Maximum quantities of Al, Si and Ge included in the known Sm-Co magnet are, by weight, about 0.12%, 0.03% and 0.01% respectively.

It should be noted that according to this invention Al, Ge and/or Si are added in more quantity than the quantities of those elements which are included in known Sm-Co permanent magnets as impurities.

According to this invention, up to 4.75 wt.% (or 0.82 by atomic ratio to Sm) Al, up to 8.5 wt.% (or 0.57 by atomic ratio to Sm) and/or up to 5.8 wt.% (or 0.98 by atomic ratio to Sm) Si are added into an $SmCo_5$ alloy in order to improve the irreversible temperature loss of the Sm-Co permanent magnet.

Figure 3:
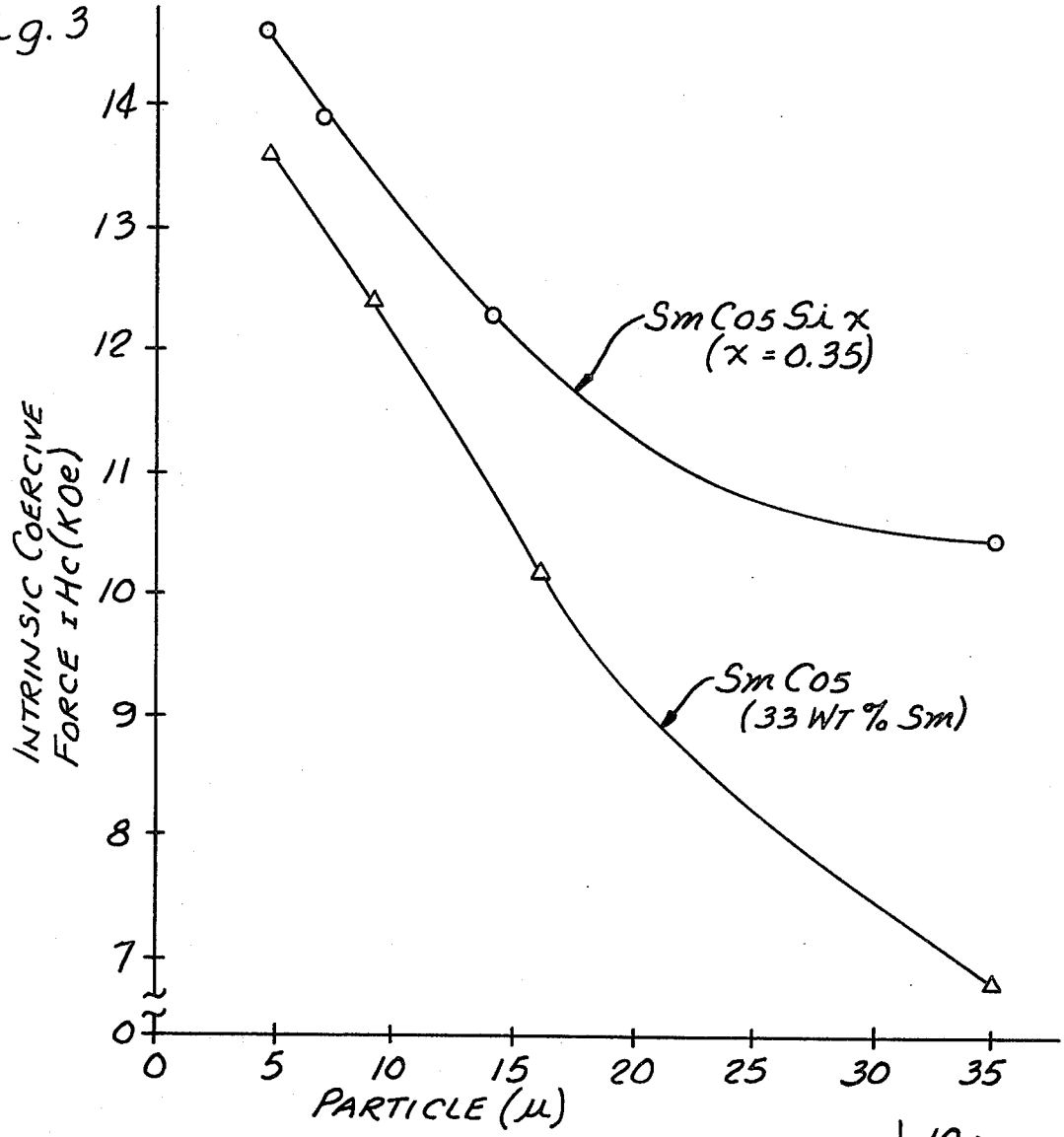

For example, referring to FIG. 3, in which the variation of the intrinsic coercive force of the $SmCo_5Si_{0.35}$ alloy to the particle size of the alloy is shown compared with the $SmCo_5$ alloy, it is noted that the intrinsic coercive force of the $SmCo_5Si_{0.35}$ alloy is greater than that of the $SmCo_5$ alloy at every particle size. The irreversible temperature loss of the permanent magnet made of the $SmCo_5Si_{0.35}$ alloy powder is understood to be reduced in comparison with that of the $SmCo_5$ permanent magnet.

The quantity of the addition may be, preferably, limited up to 0.25 by atomic ratio to Sm. Then the sintered permanent magnet made of the $SmCo_5M_x$ alloy powder exhibits improved magnetic induction besides reduced irreversible temperature loss when comparing it to the known sintered $SmCo_5$ permanent magnet.

Moreover, the quantity of the addition may be limited up to 0.21 by atomic ratio to Sm. Then the $SmCo_5M_x$ alloy provides magnet materials for a permanent magnet of the compacted type which exhibits improved magnetic induction and irreversible temperature loss when comparing it to the known compacted type $SmCo_5$ permanent magnet.

A permanent magnet using materials of this invention can be manufactured through known processes for a Sm-Co permanent magnet.

For example, in order to make a sintered type permanent magnet, $SmCo_5M_x$ alloy powder or a mixture of $SmCo_5M_x$ alloy powder and samarium rich Sm-Co alloy powder, with a particle size of 1–10 $\mu$m, is aligned in an aligning magnetic field and pressed with a pressure of 0.5 ton/cm$^2$ to form a compact. Alternatively, the powder or the mixture is pressed with a lower pressure such as about 0.3 ton/cm$^2$ in the aligning magnetic field and thereafter is pressed with a pressure of 0.5 ton/cm$^2$ in the non-magnetic field.

The compact is inserted in a furnace and is sintered for 1 hour in an inert gas such as algon after exhausting gas from the compact. Alternatively the gas exhausting process may be omitted.

After performing the sintering process, the compact is slowly cooled and then rapidly cooled from a predetermined temperature in the furnace. Alternatively the compact may be rapidly cooled from the prevailing temperature after performing the sintering treatment.

A heat treatment may be carried out after the sintering process at a temperature lower than the sintering temperature.

EXAMPLE 1

An ingot $I_1$ of 200 Kg of the alloy represented by $Sm\ Co_{4.0\text{-}5.2}\ M_x$ (M: Al, Si, Ge) and another ingot $I_2$ of 200 Kg of the alloy represented by SmCo were respectively produced by melting a starting mixture in a high frequency induction melting hearth.

The relative amount of samarium, cobalt and addition M in the finally obtained magnet were easily controlled by mixing the ingots $I_1$ and $I_2$.

The purity factors of the samarium, cobalt and additions which were used for producing these ingots were 99.9, 99 and 99.9 or more, respectively.

Each ingot was pulverized to form a powder of particle size of less than 0.3 mm. The pulverized ingots $I_1$ and $I_2$ were mixed by predetermined quantity and then milled in a vibratory mill to obtain powder of a mean particle size of 3 – 7 $\mu$m. Thereafter, the powder was compacted at a pressure of about 0.3 ton/cm$^2$ under the influence of an aligning magnetic field which was applied in parallel with the direction of the pressure and, then, was further pressed at a hydrostatic pressure of 4 ton/cm$^2$ in a non-magnetic field. The resulting compact was, thereafter, sintered.

The sintered permanent magnet was manufactured in the form of rod 3 (diameter) × 5.2 (length) or having a dimensional ratio of 0.4.

In order to obtain the magnetic inductions $Bd_0$ and $Bd_1$ of the rod type magnet, total magnetic flux from the magnet was measured by use of an electronic flux meter, before and after the baking treatment of the magnet. The baking treatment consisted of maintaining the magnet at 300°C for 3 hours.

The data relating to magnets having various compositions is shown in Table 1, in which amounts of Co and additions M were obtained by means of chemical analysis and the amount of Sm was calculated as the balance. The known Sm-Co magnets of samples No. 1 and No. 2 in Table 1 were produced through similar processes as above described.

It will be noted from the data shown in Table 1 that the magnets including additions of Al, Si and/or Ge exhibit excellent magnetic characteristics after the baking treatment.

Figure 4:
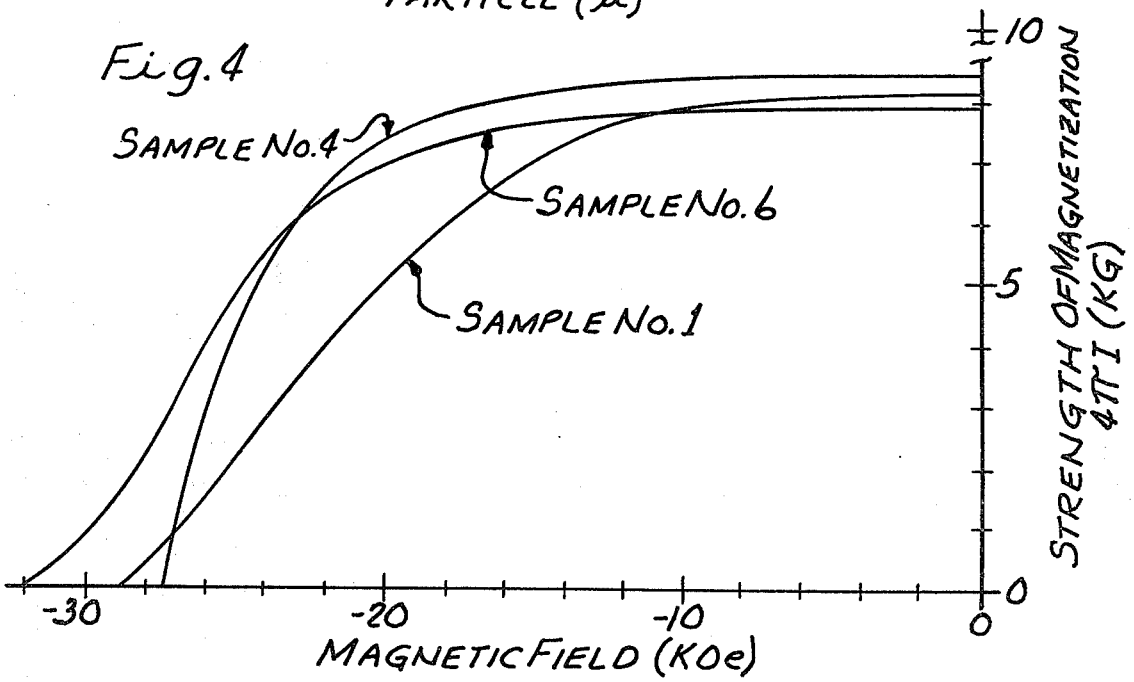

The demagnetizing response of each magnet shown in Table 1 was measured. In FIG. 4, the demagnetizing curves of magnets No. 1, 4 and 6 in Table 1 are illustrated.

Table 1

| Samples No. | Addition M | Compositions before sintering wt.% Sm | Co | M | Atomic ratios to Sm Co | M | Sintering temperature (°C) | Temperature at which rapid cooling begins (°C) | $Bd_0$ | $Bd_1$ | Irreversible temperature loss (%) | Residual flux density Br (KG) | Magnetic Flux Density at the demagnetization field of 20KO$_e$ |
|---|---|---|---|---|---|---|---|---|---|---|---|---|---|
| 1 | — | 36.0 | 64.0 | — | 4.54 | — | 1098 | 850 | 359 | 327 | −8.9 | 8.2 | 5.0 |
| 2 | — | 36.3 | 63.7 | — | 4.48 | — | 1110 | 860 | 365 | 320 | −12.3 | 8.3 | 4.2 |
| 3 | Si | 36.4 | 63.2 | 0.4 | 4.42 | 0.06 | 1110 | 850 | 342 | 335 | −2.0 | 8.0 | 7.1 |
| 4 | Si | 37.2 | 62.4 | 0.4 | 4.28 | 0.06 | 1098 | 850 | 384 | 373 | −2.9 | 8.5 | 7.4 |

Table 1-continued

| Samples No. | Addition M | Compositions before sintering wt.% Sm | Co | M | Atomic ratios to Sm Co | M | Sintering temperature (°C) | Temperature at which rapid cooling begins (°C) | $Bd_0$ | $Bd_1$ | Irreversible temperature loss (%) | Residual flux density Br (KG) | Magnetic Flux Density at the demagnetization field of 20KO$_e$ |
|---|---|---|---|---|---|---|---|---|---|---|---|---|---|
| 5 | Si | 36.6 | 62.6 | 0.8 | 4.36 | 0.12 | 1098 | 950 | 344 | 336 | −2.4 | 8.0 | 6.9 |
| 6 | Si | 36.7 | 62.2 | 1.1 | 4.32 | 0.17 | 1120 | 750 | 337 | 330 | −2.1 | 7.9 | 7.0 |
| 7 | Al | 37.0 | 62.5 | 0.5 | 4.32 | 0.08 | 1095 | 750 | 345 | 337 | −2.3 | 8.0 | 7.0 |
| 8 | Al | 37.8 | 61.8 | 0.5 | 4.17 | 0.07 | 1090 | 950 | 354 | 348 | −1.7 | 8.1 | 7.2 |
| 9 | Al | 37.2 | 61.8 | 1.0 | 4.24 | 0.15 | 1090 | 750 | 345 | 338 | −2.0 | 8.0 | 7.1 |
| 10 | Ge | 36.7 | 62.3 | 1.0 | 4.33 | 0.06 | 1090 | 850 | 341 | 337 | −1.1 | 7.9 | 7.2 |
| 11 | Ge | 37.1 | 60.9 | 1.0 | 4.19 | 0.06 | 1090 | 750 | 347 | 344 | −0.9 | 8.1 | 7.3 |
| 12 | Si | 36.2 | 61.8 | 2.0 | 4.36 | 0.30 | 1110 | 860 | 332 | 325 | −2.1 | 7.8 | 7.1 |
| 13 | Si | | | 1.0 | | 0.15 | 1120 | 750 | 340 | 332 | −2.3 | 7.9 | 7.1 |
| | Al | 35.9 | 62.6 | 0.5 | 4.45 | 0.08 | | | | | | | |
| 14 | Si | | | 0.4 | | 0.06 | 1120 | 850 | 350 | 344 | −1.7 | 8.1 | 7.3 |
| | Ge | 35.5 | 63.1 | 1.0 | 4.54 | 0.06 | | | | | | | |

From FIG. 4, it will be noted that magnets including the addition according to this invention have an improved demagnetizing response in comparison with the known Sm-Co magnets. That is, the magnetization strength $4\pi I$ of the magnets according to this invention is maintained at higher values than that for known Sm-Co magnets at a higher demagnetizing field.

With respect to a permanent magnet of the sintered type, it has been known in the prior art that the sintering temperature may remarkably affect the density and magnet properties of the sintered magnet. Accordingly, in producing a known sintered Sm-Co permanent magnet, the sintering temperature must be strictly controlled.

The use of the alloy represented by $SmCo_5M_x$ (M: Al, Si and/or Ge) may reduce the affect the sintering temperature has on the density and magnet properties of a sintered permanent magnet.

Table 2 shows densities and sintering temperatures relating to different permanent magnets having different compositions.

Table 2

| Sample No. | Addition M | Compositions wt.% Co | M | Sm | Atomic ratios to Sm Co | M | Sintering temperature (°C) | Density (g/cm³) | Residual Flux density (KG) |
|---|---|---|---|---|---|---|---|---|---|
| 1 | Si | 63.6 | 0.20 | Balance | 4.48 | 0.03 | 1090 | 7.05 | 7.2 |
| 2 | | | | | | | 1105 | 8.30 | 8.2 |
| 3 | Si | 63.6 | 0.81 | Balance | 4.56 | 0.12 | 1090 | 7.40 | 7.4 |
| 4 | | | | | | | 1105 | 8.20 | 8.1 |
| 5 | Si | 63.1 | 1.17 | Balance | 4.51 | 0.18 | 1090 | 7.95 | 7.7 |
| 6 | | | | | | | 1105 | 8.05 | 7.8 |
| 7 | — | 64.0 | — | Balance | 4.54 | — | 1090 | 7.10 | 7.1 |
| 8 | | | | | | | 1105 | 8.20 | 8.1 |
| 9 | Al | 63.6 | 0.5 | Balance | 4.52 | 0.08 | 1090 | 7.80 | 7.8 |
| 10 | | | | | | | 1105 | 8.20 | 8.1 |
| 11 | Ge | 63.0 | 1.0 | Balance | 4.46 | 0.06 | 1090 | 8.00 | 7.9 |
| 12 | | | | | | | 1105 | 8.15 | 8.1 |

Compacts before sintering were made through similar processes for all samples, that is, the alloy powder being milled in a vibratory mill for a period and, then, being compacted by a pressure of 0.8 ton/cm² under the aligning magnetic field which was applied in a perpendicular direction to the pressing.

The intrinsic coercive force of each sample magnet was over 28 KO$_e$.

The density and the residual magnetic flux density of the sintered permanent magnet are affected by variation of the sintering temperature, even if the alloy according to this invention is used, but it will be noted from Table 2 that the affection is remarkably reduced.

Accordingly, the sintered permanent magnet can be easily produced by the use of the alloy according to this invention, because the strict control of the sintering temperature is not necessary.

What is claimed is:

1. A permanent magnet alloy consisting essentially of samarium, cobalt of 4.0–5.2 by atomic ratio to the samarium and an addition of at least one element selected from the group consisting of silicon up to 0.98 by atomic ratio to the samarium, germanium up to 0.57 by atomic ratio to the samarium and aluminum up to 0.82 by atomic ratio to the samarium, at least one of said elements always being present in the alloy in an amount greater than its impurity level in known Sm-Co permanent magnets, said permanent magnet alloy having an intrinsic coercive force which is greater than that of $SmCo_5$ permanent magnet and an irreversible magnetic loss with temperature which is less than that of $SmCo_5$ permanent magnet.

2. A sintered permanent magnet consisting essentially of the alloy as claimed in claim 1.

3. A permanent magnet alloy represented by $SmCo_{4.0\text{-}5.2}M_x$, M being at least one element selected from the group consisting of silicon, germanium and aluminum, and $x$ being 0.25 or less, at least one of said elements always being present in the alloy in an amount greater than its impurity level in known Sm-Co permanent magnets, said permanent magnet alloy having an intrinsic coercive force which is greater that that of $SmCo_5$ permanent magnet and an irreversible magnetic loss with temperature which is less that that of $SmCo_5$ permanent magnet without reduction of residual magnetic flux density.

4. The permanent magnet alloy as claimed in claim 3, wherein $x$ is 0.21 by atomic ratio to Sm or less.

5. A sintered permanent magnet consisting essentially of the alloy as claimed in claim 3.

6. A sintered permanent magnet consisting essentially of the alloy as claimed in claim 4.

7. A compacted permanent magnet consisting essentially of the alloy as claimed in claim 4.

* * * * *